United States Patent [19]

Schnitzer et al.

[11] Patent Number: 4,682,559

[45] Date of Patent: Jul. 28, 1987

[54] GAS DRIVEN ANCHOR AND LAUNCHING SYSTEM THEREFOR

[75] Inventors: Emanuel Schnitzer; Leonard E. Williams, Jr., both of Houston, Tex.

[73] Assignee: Cameron Iron Works, Inc., Houston, Tex.

[21] Appl. No.: 820,650

[22] Filed: Jan. 21, 1986

[51] Int. Cl.[4] ..... B63B 21/26

[52] U.S. Cl. ..... 114/295; 124/56; 405/224; 405/228

[58] Field of Search ..... 114/295, 298, 299, 300, 114/297; 405/227, 228, 224; 175/19; 52/155, 156, 165; 124/56, 60, 64

[56] References Cited

U.S. PATENT DOCUMENTS

| | | | |
|---|---|---|---|
| 3,109,419 | 11/1963 | Hayward | 124/56 X |
| 3,212,110 | 10/1965 | Lombardo | 124/56 X |
| 3,280,782 | 10/1966 | Holm | 114/295 |
| 3,291,092 | 12/1966 | Halberg et al. | 114/295 |
| 3,311,080 | 3/1967 | Anderson et al. | 114/295 |
| 3,315,629 | 4/1967 | Standridge et al. | 114/295 |
| 3,777,688 | 12/1973 | Melhose | 114/295 X |
| 3,910,218 | 10/1975 | Taylor et al. | 114/295 |
| 4,033,281 | 7/1977 | Lundh | 114/295 |
| 4,076,313 | 2/1978 | Sperandeo, III | 114/295 X |
| 4,356,788 | 11/1982 | Stern et al. | 114/295 |
| 4,619,218 | 10/1986 | Kenny | 114/295 |

FOREIGN PATENT DOCUMENTS

| | | | |
|---|---|---|---|
| 0667640 | 6/1979 | U.S.S.R. | 114/295 |

*Primary Examiner*—Joseph F. Peters, Jr.
*Assistant Examiner*—Paul E. Salmon
*Attorney, Agent, or Firm*—Vinson & Elkins

[57] ABSTRACT

The present invention relates to an anchor system which includes an anchor projectile section having an anchor body, beams pivotally connected at their lower end to the body and interconnected by flexible segments, a pressure storage or launching section having a launching tube in which the upper body of the projectile section is positioned for being launched therefrom, a drag plate secured around the launching section with substantial weight therein and sufficient diameter to create a large virtual water mass and hydrodynamic drag to resist upward movement of the launching section when the anchor projectile section is released for launching into the sea bottom, a remotely controlled collet connector securing the anchor projectile section within the launching section until the anchor is to be launched for setting in the bottom.

11 Claims, 8 Drawing Figures

FIG. 3
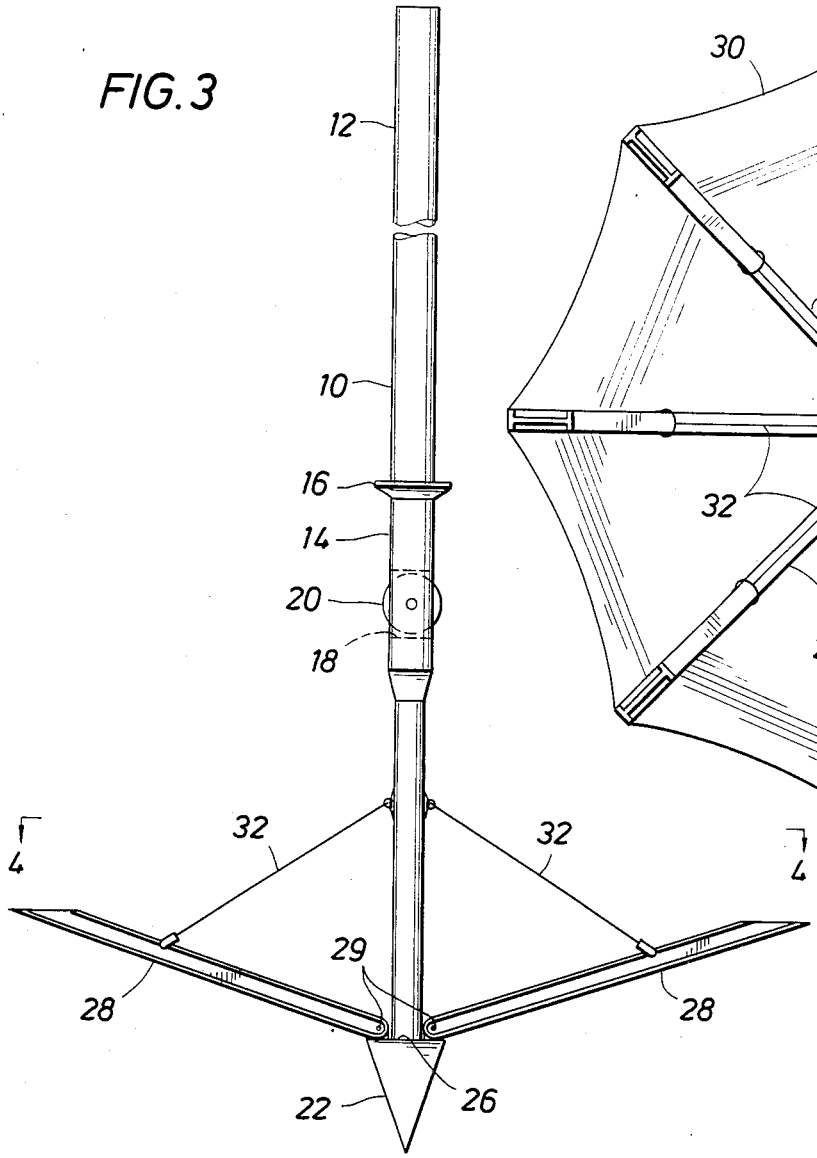
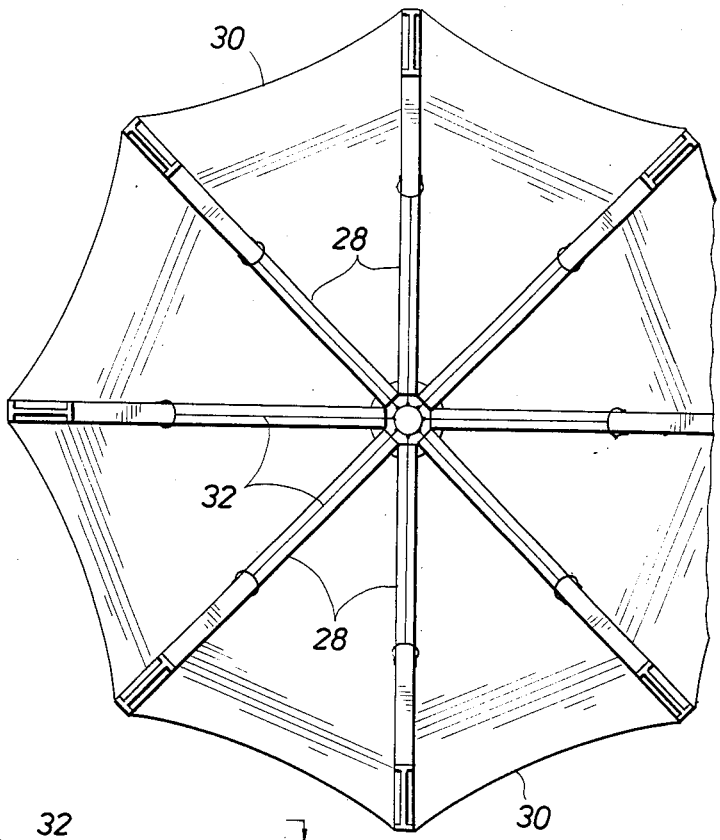
FIG. 4
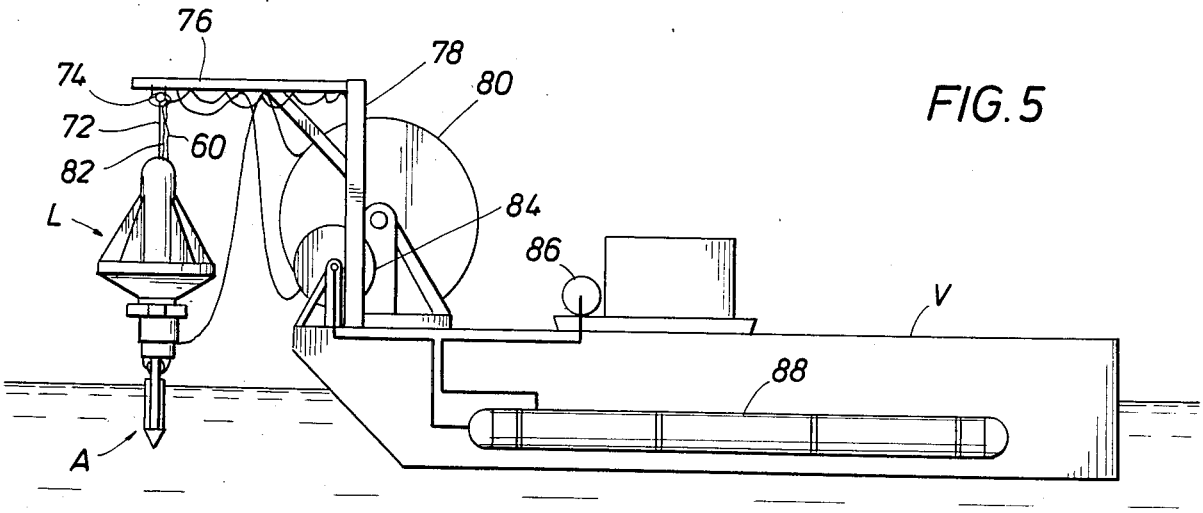
FIG. 5

GAS DRIVEN ANCHOR AND LAUNCHING SYSTEM THEREFOR

BACKGROUND

Offshore structures, vessels and floating rigs require anchors. Often the retrievable boat anchors would be used but such anchors are difficult to be embedded firmly in the sea bottom surfaces especially for holding large loads for long periods. For subsea applications, driving pilings is difficult, expensive and time consuming to set and subsea pile drivers are not available for deep water applications. Some efforts have been made to use explosive charges for driving subsea anchors into the sea bottom. U.S. Pat. No. 3,170,433 discloses one type of structure utilizing explosives for driving an anchor into the sea bottom.

Also, some efforts have been made to utilize flowing water by use of a valve to create water hammer forces or a sharp turn to create a driving force to set a subsea anchor. U.S. Pat. Nos. 3,118,417 and 3,371,643 are examples of this type of structure for setting a subsea anchor. U.S. Pat. No. 3,646,598 discloses an air type of pile driver. Other types of anchor burying structures utilizing air jets are disclosed in U.S. Pat. Nos. 4,347,802 and 4,076,313.

SUMMARY

The present invention relates to an improved subsea anchor and anchor setting system which is portable and easily and quickly set. The complete system includes an anchor projectile section having an anchor body, beams pivotally connected at their lower end to the body and interconnected by flexible segments or other suitable anchoring means, a pressure storage or launching section having a launching tube in which the upper body of the projectile section is positioned for being launched therefrom, a drag plate secured around the launching section with substantial weight therein to resist upward movement of the launching section when the anchor projectile section is released for launching into the sea bottom, means for releasably securing the anchor projectile section within the launching section until the anchor is to be launched for setting in the bottom.

An object of the present invention is to provide an improved subsea anchor and anchor setting system which is portable and may be set quickly without the danger of handling explosives.

Another object is to provide an improved portable subsea anchor which is simple and quick to set A further object is to provide an improved portable subsea anchor having low drag during setting and high drag when loaded after setting.

BRIEF DESCRIPTION OF THE DRAWINGS

These and other objects and advantages of the present invention are hereinafter set forth and explained with reference to the drawings wherein:

FIG. 3 is a detail elevation view of the anchor projectile section of the present invention with some of the pivoted beams being removed to see the typical mounting of the other beams.

FIG. 4 is a sectional view of the projectile section taken along line 4—4 in FIG. 3.

FIG. 5 is an elevation view of the improved anchor and setting system of the present invention supported from a floating vessel and in position for lowering.

DESCRIPTION OF THE PREFERRED EMBODIMENT

Figure 1:
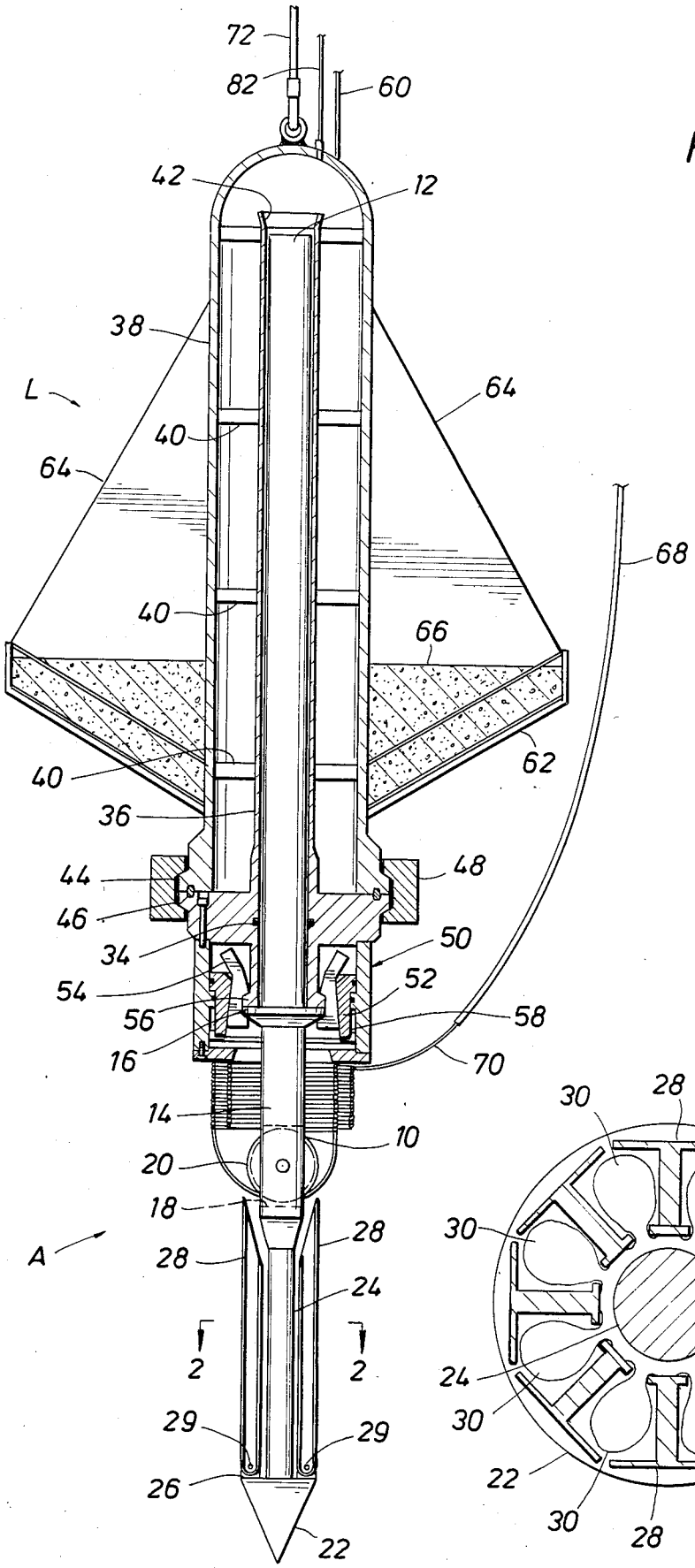
FIG. 1 is a longitudinal sectional view of the anchor and setting assembly.
Figure 2:
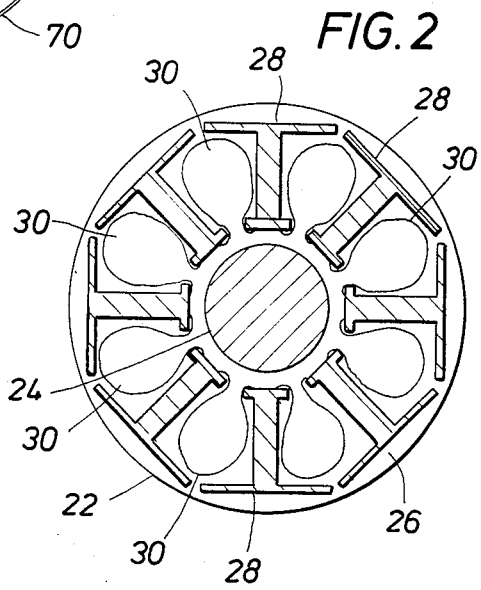
FIG. 2 is a sectional view of the anchor and setting assembly taken along line 2—2 in FIG. 1.

The improved anchor A of the present invention with the launching system structure L is shown in details in FIGS. 1 and 2 and its support from vessel V and the manner of positioning the complete structure for anchoring is disclosed in FIGS. 5 through 8. Some additional details of anchor A are shown in FIGS. 3 and 4.

Anchor A includes body 10 having upper rod 12, lower rod 14 with flange 16 therebetween. Lower rod 14 includes slot 18 near its upper end in which pulley 20 is positioned for the reasons hereinafter set forth. Cone 22 is positioned on the lower end of lower rod 14. Rod 14 immediately above cone 22 is of a reduced diameter as shown at 24 which extends upwardly to a point a short distance below slot 18. Shoulder 26 formed above cone 22 faces upwardly and beams 28 are pivotally mounted thereto by suitable pivoting means 29 such as pins and brackets so that in their retracted position as shown in FIGS. 1 they have a diameter smaller than the outer diameter of shoulder 26 or they are within the shadow of cone 22. Positioned between beams 28 as shown in FIGS. 2 and 4 are foldable segments 30 of expandable metal plate sectors or flexible composite fabric sheets. Cables 32 are connected to the reduced section of lower rod 14 and to a point on beams 28. The outer surface of upper rod 12 is smooth and round to ensure a proper seal by seal ring 34 within tube 36 which is supported axially within pressure vessel 38.

Launching system L includes pressure vessel 38 with tube 36 supported within vessel 38 by braces 40. The upper end of tube 36 is flared outward as shown at 42 and is spaced from the upper interior of vessel 38. The lower end of vessel 38 is surrounded by flange 44 which is secured to flange 46 on the exterior of tube 36 by clamp 48. Releasable engaging means 50 connects from launching structure L to anchor A and includes collet connector 52 which includes fingers 54 engaging end flange 56 on tube 36 and flange 16 on anchor body 10. Collet connector 52 also includes an actuator (not shown) which causes wedge ring 58 to be moved with respect to fingers 54 in the usual manner. A suitable source of hydraulic fluid is supplied to connector 52 through line 60. Drag pan 62 is secured around the exterior of pressure vessel 38 and is supported therefrom by gussets 64. As shown, drag pan 62 is slightly conical with the apex of the cone facing downward. The interior of pan 62 is suitable weighted as by filling the upper interior of pan 62 with concrete 66 or other weighting material. Pan 62 has sufficient diameter to create a vertical water mass and hydrodynamic drag.

Anchor cable 68 connects to messenger cable 70 which is coiled around lower rod 14 immediately above pulley 20. Messenger cable 70 extends through slot 18 in engagement with pulley 20 and connects to the lower end of collet connector 52 which is secured to the lower end of pressure vessel 38.

As shown in FIG. 5, anchor A and launching system structure L are supported from vessel V by lifting cable 72 which extends to structure L from hoist 74 that is supported on arm 76 mounted on davit 78 on the deck of vessel V. Anchor cable 68 extends to drum 80 and hydraulic line 60 and fluid pressurizing line 82 which connects to the upper end of pressure vessel 38 are mounted on drums such as drum 84. Vessel also includes compressor 86 which connects to enlongated storage tanks 88 which may be supported on the exterior of vessel V. Line 82 connects to tanks 88 through suitable controls for the charging of the interior of pressure vessel 38.

Figures 6, 7, 8:
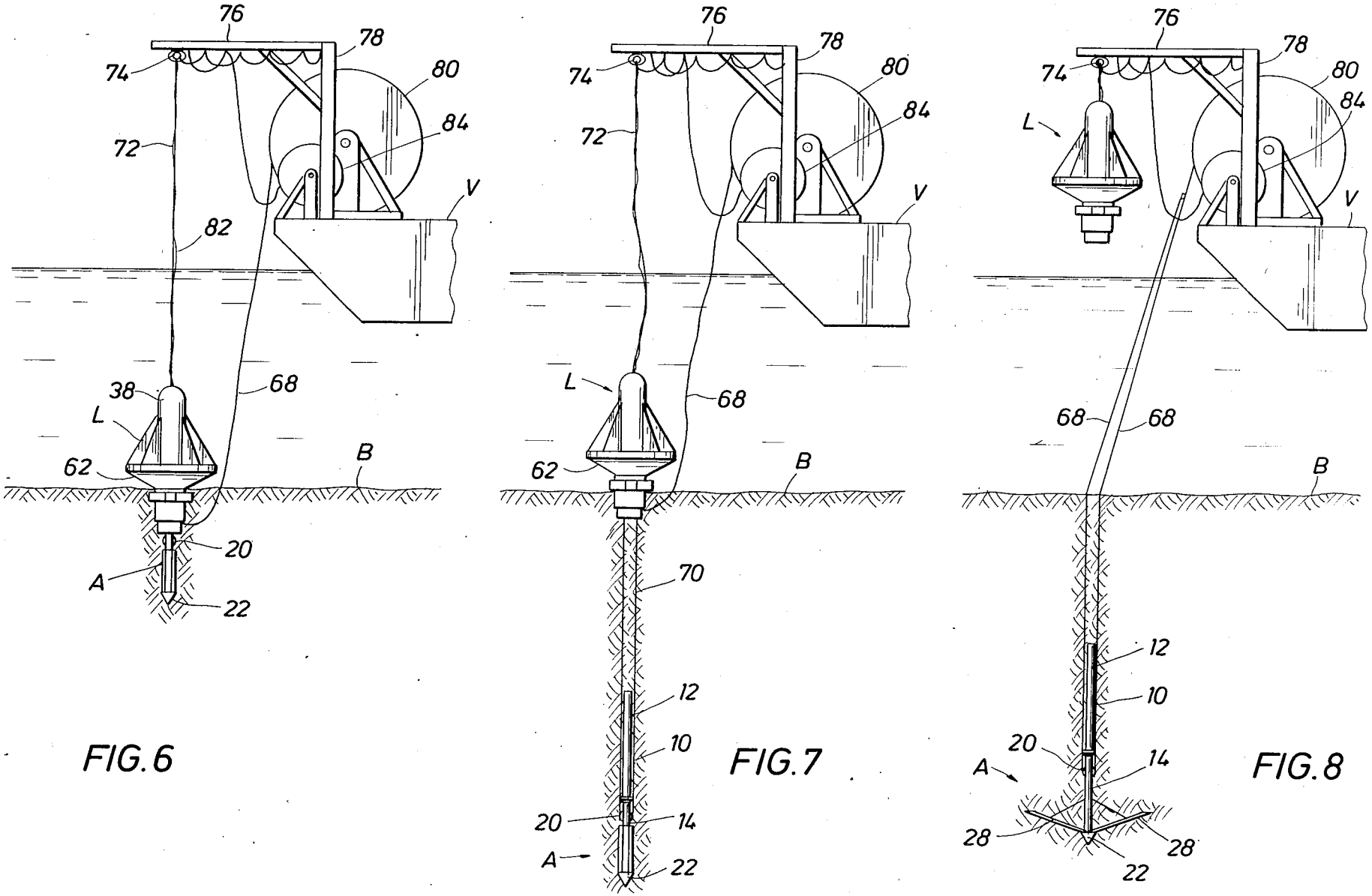
FIG. 6 is an elevation view showing the anchor lowered to its pre-launching position embedded in the sea bottom.
FIG. 7 is an elevation view illustrating the anchor projectile section having been ejected into the sea bottom.
FIG. 8 is another elevation view illustrating the deployment of the holding portion of the anchor section.

With the anchor A and launching structure L positioned as shown in FIG. 5, they are lowered downward through the water until anchor A is embedded in sea bottom B with launching structure L positioned on the surface of sea bottom B. The anchor A preferably is fully into the sea bottom B with launching structure L having its pan near sea bottom B as shown in FIG. 6. In this position, launching structure L is charged through pressurizing line 82.

With launching system fully charged, collet connector 52 is disengaged allowing the charge of fluid pressure within pressure vessel 38 to expand with the movement of anchor rod 12 downwardly through tube 36 to launch anchor A into the sea bottom B. Sufficient pressure is provided in pressure vessel 38 to allow anchor A to be launched into sea bottom B with sufficient force to cause anchor A to move through sea bottom B to a depth which allows the desired anchoring. The position of anchor A at the end of its movement through the earth at sea bottom is shown in FIG. 7.

Since messenger cable 70 is connected between the lower end of collet connector 72 to anchor cable 68, the retrieving of launching structure L, as shown in FIG. 8, brings the collet connector end of messenger cable 70 to the vessel V. Messenger cable 70 is pulled from the vessel V causing anchor cable 68 to be pulled through pulley 20 and back to vessel V. With anchor cable 68 secured on vessel V, it is hoisted to cause anchor A to be set as shown in FIG. 8. The upward movement of anchor A causes beams 28 to pivot outwardly until they are in a position supported by cables 32 and segments 30 are unfolded to provide an inverted umbrella-like structure expanded into the earth of sea bottom B. In this expanded position, anchor A is firmly set and provides the desired anchoring through anchor cable 68. Also, it should be noted that the doubling of anchor cable 68 over pulley 20 allows easy replacement of anchor cable 68 whenever it is in need of replacement due to wear or corrosion or other damage.

What is claimed is:

1. An anchor comprising a pressure storage section having a pressure vessel, an inlet for introducing gas under pressure therein, and a central tube open at its upper end within said pressure vessel and open at its lower end to the exterior of said pressure vessel, a groove around the interior of said central tube near its open lower end, a seal positioned within said groove in said central tube, a projectile section having a rod with a cone on its lower end, the upper portion of said rod positioned within said central tube and having a diameter to be in sealing engagement with said seal as said rod is moved axially through said central tube, and a remotely controlled collet connector releasably securing said projectile section to said pressure storage section.

2. An anchor an launching system comprising a launcher having an elongated pressure vessel with a launch tube extending axially within said pressure vessel and open at its upper end within said vessel and extending through the lower end of the vessel, an anchor having a body with its upper end being slidably postioned within said launch tube and having a downwardly pointed lower end and movable elements pivotally secured near the lower end of the body above said pointed lower end and arranged within a circle having a diameter less than the diameter of the upper portion of said pointed end, sealing means between the lower interior of said launch tube and the exterior of said body.

an anchor line connected between said anchor and said launcher, means for lowering and hoisting said launcher between the sea bottom and the water surface, means releasably connecting the anchor to the launcher, means for supplying gas under pressure to said pressure vessel in its launch position on the sea bottom, and means for remotely releasing said connecting means after the charging of said pressure vessel with gas.

3. An anchor and launching system according to claim 2 wherein the upper end of said launch tube within said pressure vessel is flared outwardly and upwardly to reduce pressure loss in fluid flow from the pressure vessel into the launch tube.

4. An anchor and launching system according to claim 2 wherein the intermediate portion of anchor body includes a slot, and a pulley mounted in said slot, and said anchor line includes an anchor cable, and a messenger line extending through said slot and in engagement with said pulley, one end of said messenger line being secured to said pressure vessel and the other end being secured to the anchor cable.

5. An anchor and launching system according to claim 2 wherein said movable elements include a plurality of a beams pivotally connected to said anchor body, and foldable segments extending between adjacent pairs of said beams.

6. An anchor and launching system according to claim 2 including a drag pan secured around the lower exterior of said pressure vessel, said drag pan being conical in shape with the apex of the cone pointing downwardly, and a substantial amount of weight positioned in said drag pan.

7. An anchor and launching system according to claim 6 wherein said weight positioned in said drag pan is concrete within the upper portion of the pan.

8. An anchor and launching system according to claim 2 including a flange on the intermediate portion of said anchor body, and a remotely actuated collet connector supported from said pressure vessel and having means for releasably engaging said flange on said anchor body.

9. An anchor and launching system according to claim 2 including a floating vessel having means for raising and lowering said launcher and said anchor to the sea bottom, means for supplying compressed air to said launcher in position on the sea bottom, an anchor cable supported from said floating vessel, and means extending from said floating vessel for releasing said releasable connecting means between said launcher and said anchor.

10. An anchor suitable for launching into the sea bottom comprising a body having an elongated upper end which has a cylindrical exterior surface and a downwardly pointed cone at its lower end, a slot in said body, and a pulley mounted in said slot, and said anchor line including an anchor cable, and a messenger line extending through said slot and in engagement with said pulley, one end of said messenger line being secured to the anchor cable and the other end being secured to an element retrievable to the water surface, means on said body for being releasably engaged prior to its launching, and movable elements pivotally secured near the lower end of said body above the cone and arranged within a circle having a diameter less than the diameter of the upper end of the cone, said elements movable from a pre-launched position extending along the exterior of said body to an anchor set position extending outwardly and upwardly to secure the anchor body in such position.

11. An anchor launcher for launching an anchor into the sea bottom comprising an upright pressure storage vessel, a launch tube positioned within said vessel and extending axially therein with its upper end spaced from the upper interior of said vessel and its lower end extending through the lower end of said pressure vessel, a groove around the interior of said launch tube near its lower end, a seal ring positioned within said groove for sealing against a portion of an anchor to be launched therefrom, and means for releasably engaging an anchor until it is to be launched.

* * * * *